United States Patent [19]

Nagashima et al.

[11] Patent Number: 4,638,709

[45] Date of Patent: Jan. 27, 1987

[54] ELECTRONIC MUSICAL INSTRUMENT WITH TEMPORAL VARIATION DATA GENERATING CIRCUIT AND INTERPOLATION CIRCUIT

[75] Inventors: Yoichi Nagashima, Hamamatsu; Tatsunori Kondo, Shizuoka; Kiyomi Takauji; Mineo Kitamura, both of Hamamatsu; Tadashi Matsushima, Hamamatsu; Eiji Nagashima, Kami; Masafumi Mizoguchi, Hamamatsu, all of Japan

[73] Assignee: Kabushiki Kaisha Kawai Gakki Seisakusho, Japan

[21] Appl. No.: 665,125

[22] Filed: Oct. 26, 1984

[30] Foreign Application Priority Data

Oct. 27, 1983 [JP] Japan ..... 58-201663

[51] Int. Cl.[4] ..... G10H 7/00

[52] U.S. Cl. ..... 84/1.19; 84/1.21; 84/1.22

[58] Field of Search ..... 84/1.01, 1.11–1.13, 84/1.19–1.23, 1.26

[56] References Cited

U.S. PATENT DOCUMENTS

| | | | |
|---|---|---|---|
| Re. 31,653 | 8/1984 | Takeuchi | 84/1.21 |
| 3,908,504 | 9/1975 | Deutsch | 84/1.19 |
| 4,205,575 | 6/1980 | Hoskinson et al. | 84/1.01 |
| 4,246,823 | 1/1981 | Wachi et al. | 84/1.22 |
| 4,257,303 | 3/1981 | Nagai et al. | 84/1.22 |
| 4,352,312 | 10/1982 | Whitefield et al. | 84/1.21 |
| 4,409,877 | 10/1983 | Budelman | 84/1.23 |
| 4,444,082 | 4/1984 | Whitefield | 84/1.21 |
| 4,471,681 | 9/1984 | Nishimoto | 84/1.23 |
| 4,478,124 | 10/1984 | Kikumoto | 84/1.19 |
| 4,479,411 | 10/1984 | Ishibashi | 84/1.01 |
| 4,536,853 | 8/1985 | Kawamoto et al. | 84/1.01 X |
| 4,562,763 | 1/1986 | Kaneko | 84/1.01 |

*Primary Examiner*—S. J. Witkowski

*Attorney, Agent, or Firm*—McGlew and Tuttle

[57] ABSTRACT

In an electronic musical instrument which generates a musical waveform by calculating the waveform amplitude value at each sample point through Fourier synthesis, temporal variations of the musical waveform and its timbre variations in accordance with a touch response are controlled with respect to readout addresses for reading out a set of harmonic coefficient data for the Fourier synthesis from a memory having stored therein a plurality of sets of such harmonic coefficient data, thereby changing the component ratio of a harmonic coefficient which will ultimately be used as a Fourier coefficient.

2 Claims, 15 Drawing Figures

ADDRESS
TIME

ADDRESS
A
C
B
La
Lc
Lb
TIME

ADDRESS
D
E
Ld
Le
TIME

ADDRESS
F
G
TIME

ELECTRONIC MUSICAL INSTRUMENT WITH TEMPORAL VARIATION DATA GENERATING CIRCUIT AND INTERPOLATION CIRCUIT

BACKGROUND OF THE INVENTION

1. Field of the Invention

The present invention relates to an electronic musical instrument of the type that generates a musical waveform by computing the amplitude value of a musical waveform at each sample point thereof through Fourier synthesis, and more particularly to an electronic musical instrument which is adapted so that harmonic coefficient for setting a timbre is varied with time and in accordance with a touch response.

2. Description of the Prior Art

Heretofore, there have been proposed many digital type electronic musical instruments which produce the amplitude value of a musical waveform at each sample point thereof by some method and read it out at a read-out rate corresponding to a note frequency. The simplest one of them is what is called a "waveform-memory method" which stores and reads out waveform data itself, and a method that converts an analog input to digital form to obtain waveform data is also one of the simplest method. However, these conventional methods are defective in that an enormous memory capacity is needed for variations in the musical waveform in accordance with particular sound ranges and in that the musical waveform undergoes no temporal variations. Furthermore, there have also been considered a method of computing paramters through the use of various continous functions and a method of computing temporal variations in the musical waveform in a real-time waveform synthesis by a frequency modulation method, but the correspondence between a parameter for the waveform generation and the timbre of the musical sound actually produced is unnatural to the human sense, and a desired timbre is difficult to obtain.

On the other hand, a musical waveform generating system utilizing Fourier synthesis has undergone various improvements to make up for the defect of a large volume of waveform synthesis calculation and has been widely employed since parameters for harmonic coefficients naturally correspond to an auditory evaluation of timbre. In the musical waveform generation system utilizing Fourier synthesis, it is the component ratio of a harmonic coefficient that determines the timbre of a musical sound. As a method for causing temporal variations in the musical waveform, there has been suggested a method of selecting many harmonic coefficients by using a plurality of memories, but this method has such a shortcoming that sufficient timbre variations cannot be obtained in spite of an enormous circuit scale. Furthermore, a system which multiplies a preset harmonic coefficient and a parameter of a Formant filter, as described in Japanes Patent Publication No. 46445/78 and a system which multiplies a temporal variation function for each harmonic coefficient, as described in Japanese Patent Public Disclosure No. 172396/84, both require a multiplication circuit and possess such a defect that its circuit scale and operation time impose limitations on the entire system, resulting in temporal variations of the musical waveform being insufficient.

SUMMARY OF THE INVENTION

It is therefore an object of the present invention to provide an electronic musical instrument which produces temporal variations in a harmonic coefficient, without using a multiplier, thereby simplifying its circuit arrangement and reducing its operating time.

Briefly stated, according to the present invention, temporal variations of a musical waveform and its variations in accordance with a touch response are controlled with respect to readout addresses for reading out a set of harmonic coefficient data for Fourier synthesis from a memory circuit having stored therein a plurality of sets of such harmonic coefficient data, thereby changing the component ratio of a harmonic coefficient which will ultimately be used as a Fourier coefficient.

BRIEF DESCRIPTION OF THE DRAWINGS

FIG. 3(*b*) is a graph showing the harmonic adresses which are read out by the address generator of the example shown in FIG. 2;

FIG. 3(*c*) is a graph showing the harmonic coefficient data which are read out at intervals from the harmonic data of FIG. 3(*b*);

FIG. 5(*b*) is a graph showing the read-out adresses from a read-out generator of the embodiment of FIG. 4;

FIG. 5(*c*) is a graph showing the interpolation values in the form of harmonic structure of a musical wave form generated by the embodiment of FIG. 4;

FIG. 8(*b*) is a graph showing how the envelope characteristic of the musical sounds from a natural instrument can have its depth changed by the operation of the embodiment shown in FIGS. 6 and 7;

FIG. 8(*c*) is a graph showing how the harmonic coefficient characteristic can be greatly changed by operating the embodiment of FIGS. 6 and 7; and FIG. 8(*d*) is a graph similar to FIG. 8(*c*) showing other variations in the harmonic coefficient characteristic which are possible according to the invention.

DESCRIPTION OF THE PREFERRED EMBODIMENTS

Figure 1:
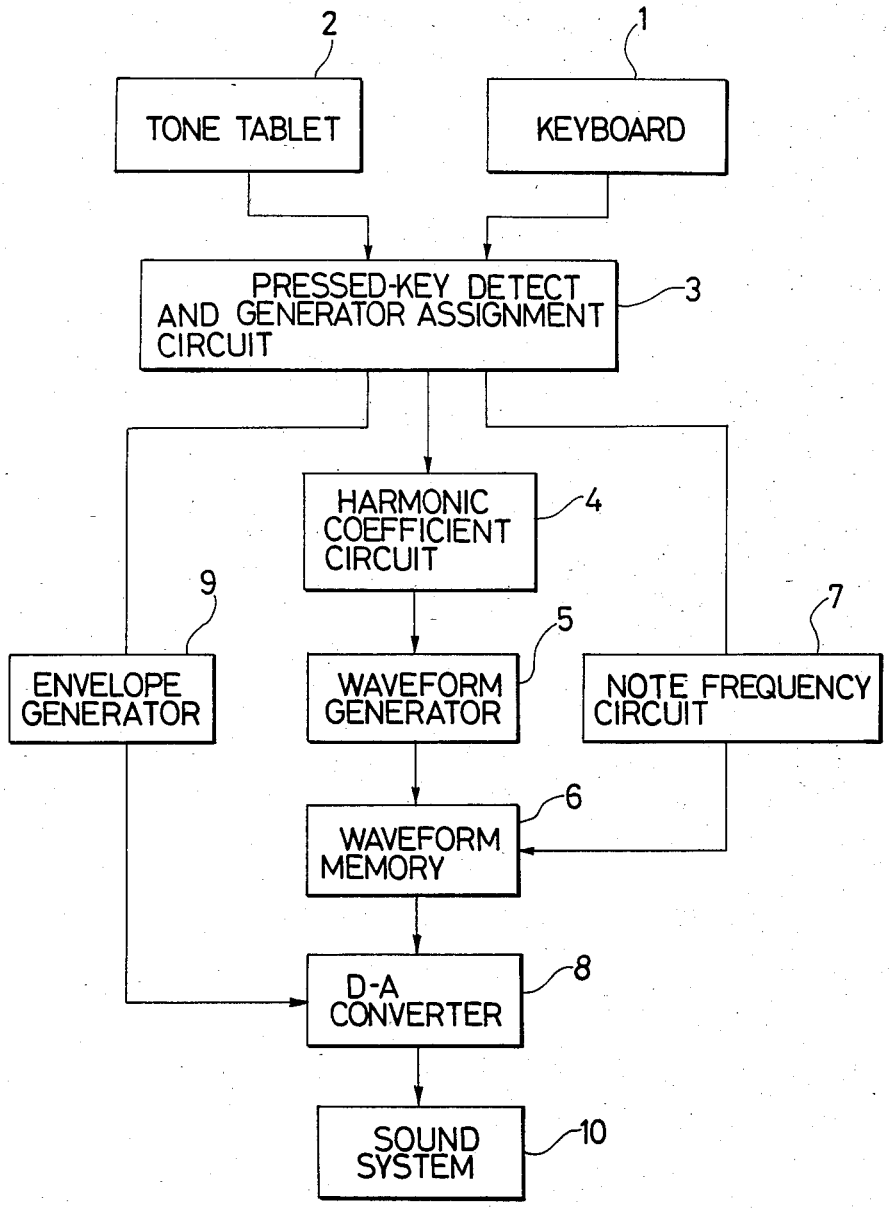
FIG. 1 is a block diagram which explains of the arrangement of the electronic musical instrument of the present invention.

FIG. 1 illustrates in block form the arrangement of the electronic musical instrument of the present invention. Reference numeral 1 indicates a keyboard; 2 designates a tone tablet; 3 identifies a pressed-key detect and generator assignment circuit; 4 denotes a harmonic coefficient circuit; 5 represents a waveform generator; 6 shows a waveform memory; 7 refers to a note frequency circuit; 8 signifies a D-A converter; 9 indicates an envelope generator; and 10 designates a sound system.

The pressed-key detect and generator assignment circuit 3 supplies each of the harmonic coefficient circuit 4, the note frequency circuit 7 and the envelope generator 9 with a control signal corresponding to timbre data and performance data input from the keyboard 1 and the tone tablet 2. The harmonic coefficient circuit 4 responds to the timbre data from the pressed-key detect and generator assignment circuit 3 to set a Fourier harmonic coefficient for a waveform synthesis calculation. The waveform generator 5 sequentially calculates and synthesizes musical waveforms on the basis of the Fourier harmonic coefficient from the harmonic coefficient circuit 4 and provides them to the waveform memory 6. The note frequency circuit 7 responds to the performance data from the pressed-key detect and generator assignment circuit 3 to generate a readout signal corresponding to a musical frequency, by which signal the musical waveform corresponding to the musical frequency is read out of the waveform memory 6. The envelope generator 9 responds to the performance data from the pressed-key detect and generator assignment circuit 3 to set amplitude modulation data such as the rise and fall of each musical sound and its envelope characteristic. By performing the above operations digitally on a time-shared basis, the circuit arrangement can be simplified. The D-A converter 8 converts the musical waveform corresponding to the musical frequency, read out by the note frequency circuit 7 from the waveform memory 8, into analog form and multiplies it by the amplitude modulation data from the envelope generator 9, obtaining an analog signal output. The analog signal output from the D-A converter 8 is converted, by the sound system 10 including an effect circuit, an amplifier and a speaker, into a musical sound of the electronic musical instrument.

Figure 2:
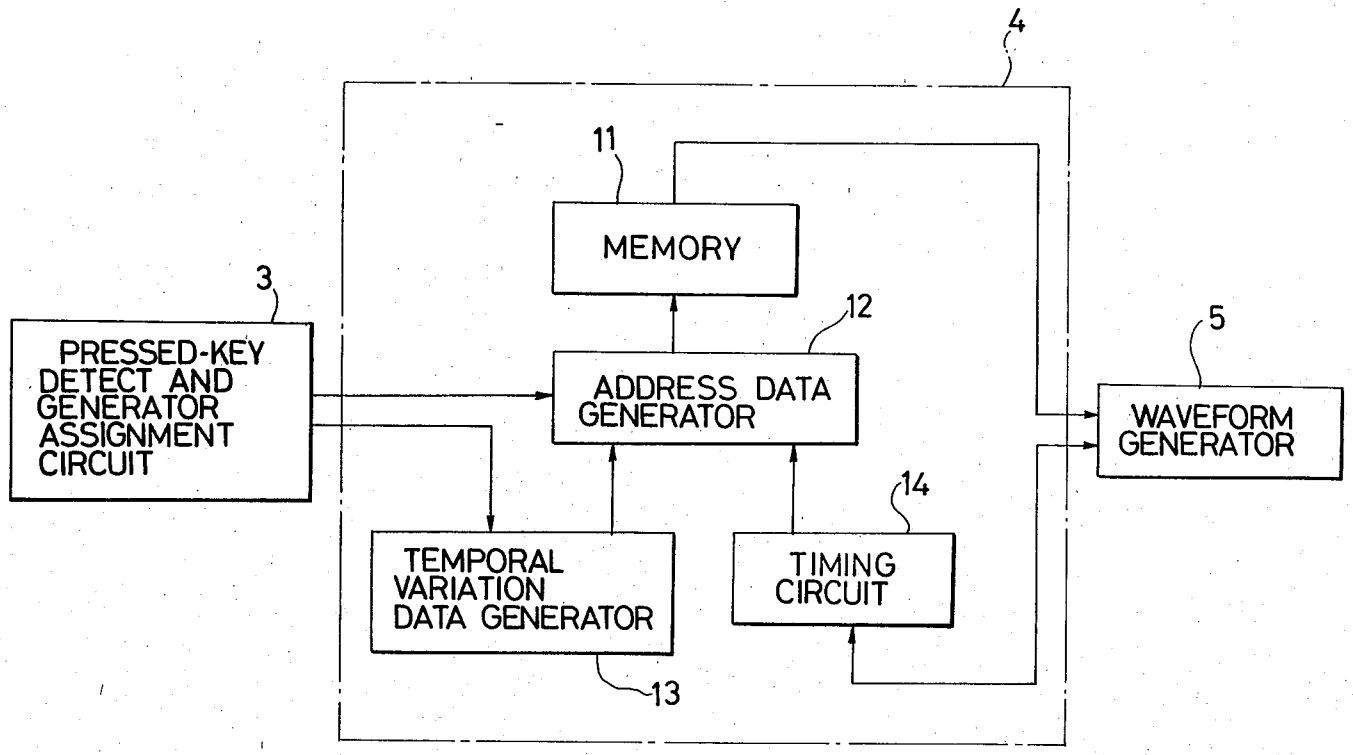
FIG. 2 is a block diagram illustrating a specific operative example of the arrangement of a harmonic coefficient circuit 4 shown in FIG. 1.

FIG. 2 illustrates a specific operative example of an arrangement for processing temporal variations of the musical waveform according to the present invention which is provided in the harmonic coefficient circuit 4 used in FIG. 1. In FIG. 2, reference numeral 11 indicates a memory circuit which stores a plurality of sets of harmonic coefficient data each set of which is used for Fourier synthesis; 13 designates a temporal variation data generator which generates data for varying the component ratio of the harmonic coefficient with time in response to the temporal variations of the musical waveform; 12 identifies an address data generator which generates readout addresses for reading out the harmonic coefficient data from the memory circuit 11 while varying them in accordance with the temporal variation data; and 14 denotes a timing circuit for synchronizing the time-shared operations of the waveform generation 5 and the address data generator 12.

A description will be given, with reference to FIG. 2, of the operation of computing and synthesizing a musical waveform by the waveform generator 5. In general, amplitude values of the musical waveform are sequentially computed by the waveform generator 5 in accordance with the following expression:

$$F(s) = \sum_{n=1}^{N} Cn \cdot \sin(2\pi ns/S) \tag{1}$$

where n is the degree of harmonics, N is the highest degree of the harmonics, s is the sample point, S is the number of samples in one cycle and Cn is a harmonic coefficient set by the harmonic coefficient circuit 4. The expression (1) is sufficient for synthesizing a timbre of a constant musical waveform, but in the case of synthesizing a temporally varying musical waveform, it is necessary to perform the following operation using a temporal parameter t in addition to the sampling constant:

$$F(s, t) = \sum_{n=1}^{N} Cn(t) \cdot \sin(2\pi ns/S) \tag{2}$$

In the case of the method which employs a Formant function f(t) as referred to previously, since the harmonic coefficient Cn(t) is computed as follows:

$$Cn(t) = Cn \cdot f(t) \tag{3}$$

the entire operation for the musical waveform becomes as follows:

$$F(s, t) = \sum_{n=1}^{N} Cn \cdot f(t) \cdot \sin(2\pi ns/S) \tag{4}$$

As a result of this, the multiplying operation, which is given much weight in the circuit operation of the electronic musical instruments, is needed twice for each sample point, so that it is necessary to limit the number of harmonics or the number of sample points for one cycle according to the scale of the circuit used and its operating speed.

With such an arrangement as shown in FIG. 2, the temporally varying musical waveform is obtained by the memory circuit 11, the temporal variation data generator 13 and the address data generator 12 without involving such a multiplying operation as mentioned above. The harmonic coefficient Cn(t) is obtained by the following operation using an address Ad for reading out the memory circuit 11:

$$Cn(t) = Cn(Ad(t)) \tag{5}$$

Figure 3A:
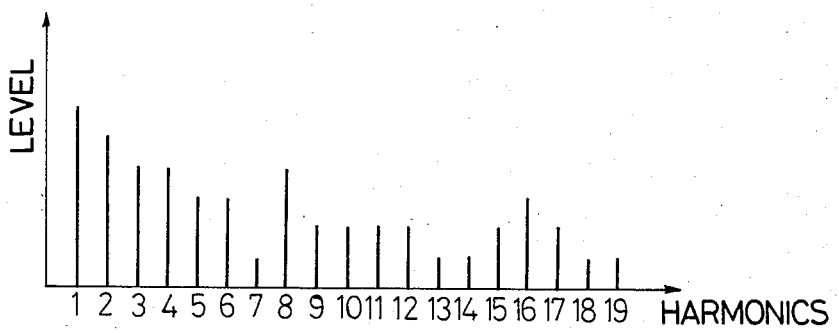
FIG. 3(*a*) is a graph showing the one set of harmonic coefficients in a Fourier systhesis system which are stored in memory for a wave form synethesizing calculation for the operation of the example shown in FIG. 2.
Figure 3B:
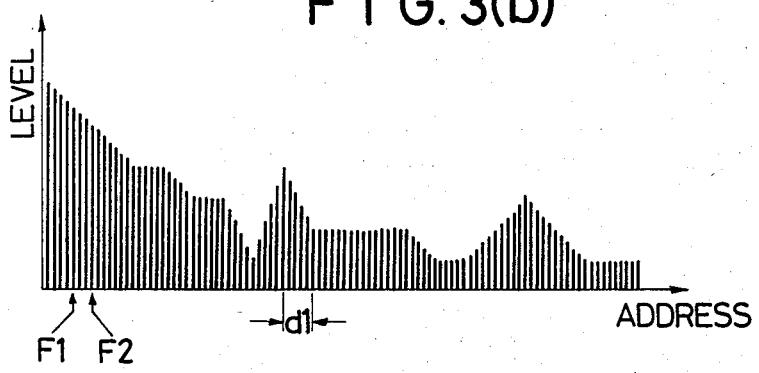
Figure 3C:
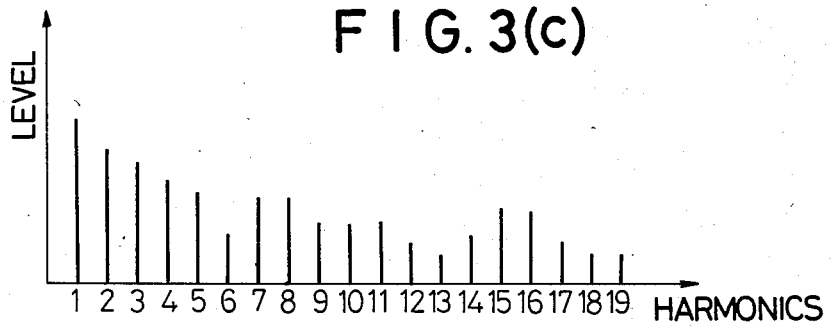

This is merely a memory addressing operation, and hence can easily be performed without involving any complicated arithmetic circuit. This operation will be described with reference to FIGS. 3(*a*) to 3(*c*). In the Fourier sysnthesis according to the prior art system, such harmonic coefficients as shown in FIG. 3(*a*) are prepared in a harmonic coefficient memory for the waveform synthesizing calculation and the waveform generation is carried out according to the expression (1). In the present invention, however, the function of the memory circuit 11 differs from the function needed in the conventional system. The memory circuit 11 in FIG. 2 has stored therein such harmonics data as shown in FIG. 3(*b*), which is not in the form of Fourier coefficients of n-th harmonics such as shown in FIG. 3(*a*) but is merely a series of harmonics data having a certain structure. In the case where the harmonics data shown in FIG. 3(*b*) is read out, by the address data generator 12 in FIG. 2, at intervals of d1, starting at, for example, an address F1, such harmonic coefficient data as shown in FIG. 3(*a*) is obtained. When the harmonics data of FIG. 3(*b*) is read out at intervals of d1, starting at an address F2, such harmonic coefficient data as shown in FIG. 3(*c*) is obtained. Comparison of the harmonic coefficient structures of FIGS. 3(*a*) and 3(*c*) reveals that the both data are generally similar in profile to the harmonics data of FIG. 3(*b*) but greatly different in the levels of some characteristics harmonics which affect timbre. Such a characteristic that the musical waveform can be controlled only by slightly controlling the readout addresses form the address data generator 12 in FIG. 2 and the general tendency of the musical sound is retained is ideal for the musical waveform generating system of electronic musical instruments.

The temporal variation data generator 13 in FIG. 2 generates as timbre variations at the moment of attack of a musical sound, temporal variation data which correspond to sounds which are produced as at the moment of hammering strings of a piano or at the start of blowing a trumpet or playing a bass fiddle, or temporal variation data corresponding to a wow-wow effect which is a periodic timbre variation. This can easily be achieved by the employment of such an ADSR envelope generator as described in Japanese Pat. Pub. Disc. No. 93315/79, or by generating an envelope in analog form and converting it to digital form. This temporal variation data progresses under the control of a temporal parameter of its own on the basis of the ON/OFF operation of the keyboard, and the data is not synchronized with the timing of sampling by the waveform data generator 5. The timing circuit 14 supplies the address data generator 12 with data on the degree of harmonics obtained by the Fourier calculation in the waveform data generator 5, and at the same time, controls the timing of time-shared operations of the entire circuit. When obtaining the harmonic coefficient data read out by the address data generator 12 from the memory circuit 11 according to the expression (2), it is seen that the operation of-the waveform data generator 12 at a certain sample point s is a combination of a multiplication and an accumulation every n-th harmonics by which the result of multiplication, G(n, s, t), every h-th harmonics given by $$G(n, s, t)=Cn(t)\cdot\sin(2\pi ns/S) \tag{6}$$

is accumulated to an N-th degree as follows:

$$F(s, t) = \sum_{n=1}^{N} G(n, s, t) \tag{7}$$

For each time slot of this multiplication, the address data generator 12 receives degree-of-harmonics data n from the timing circuit 14 and temporal variation data from the temporal variation data generator 13. Here, an address for reading out an n-th harmonic coefficient of such harmonics data of FIG. 3(*b*) at a time t can be set as follows:

$$Ad(t, n)=P1+(n-1)\cdot d+V(t) \tag{8}$$

where P1 is an address for reading out the harmonic coefficient of a fundamental tone (a first harmonics), d is a "skip" value for the aforementioned "skipped" readout and V(t) is termporal variation data. The calculation of the expression (8) appears to be troublesome. In practice, however, if the skip value d is selected to be a fixed high-order address of the memory, then the actual operation becomes a mere addressing operation and the temporal variation data V(t) is a function of the temporal variation parameter t alone, so that the calculation of the expression (8) is easy to achieve. For such an address, the memory circuit 11 functions as a kind of translation table M which provides the harmonic coefficient Cn(t) in the expression (5) and supplies the waveform data generator 5 with such harmonics data as follows:

$$Cn(t)=M(Ad(t, n))=M(P1+(n-1)\cdot d+V(t)) \tag{9}$$

On the basis of the above data, the waveform data generator 5 performs, for each multiplication time slot, the following operation:

$$G(n, s, t)=(M(P1+(n-1)\cdot d+V(t))\cdot\sin(2\pi ns/S) \tag{10}$$

For synchronizing the three parameters n, s and t, the timing circuit 14 latches data necessary therefor and supplies required latch pulses to the circuits concerned and, at the same time, it participates in the address formation by the address data generator 12.

Figure 4:
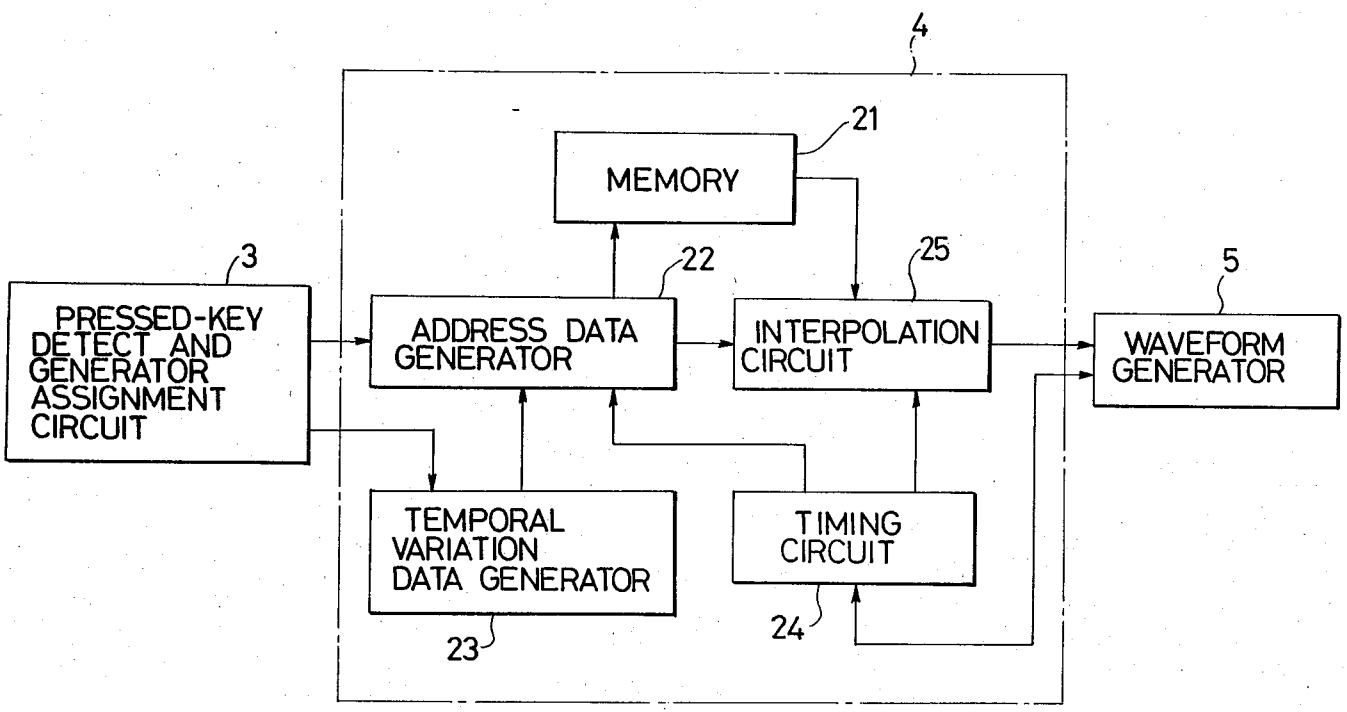
FIG. 4 is a block diagram illustrating another specific operative example of the arrangement of the harmonic coefficient circuit 4.

FIG. 4 illustrates another embodiment of the harmonic coefficient circuit 4. In FIG. 4, reference numeral 21 indicates a memory circuit which stores a plurality of sets of harmonic coefficient data each set of which is used for Fourier synthesis; 23 designates a temporal variation data generator which generates data for varying the component ratio of the harmonic coefficient with time in response to the temporal variations of a musical waveform; 22 identifies an address data generator which generates addresses for reading out the harmonic coefficient data from the memory circuit 21 while varying them in accordance with the temporal variation data; 25 denotes an interpolation circuit for interpolating the harmonic coefficient data read out from the memory circuit 21 by the readout addresses from the address data generator 22; and 24 represents a timing circuit for synchronizing time-shared operations of the waveform data generator 5, the address data generator 22 and the interpolation circuit 25.

Figure 5A:
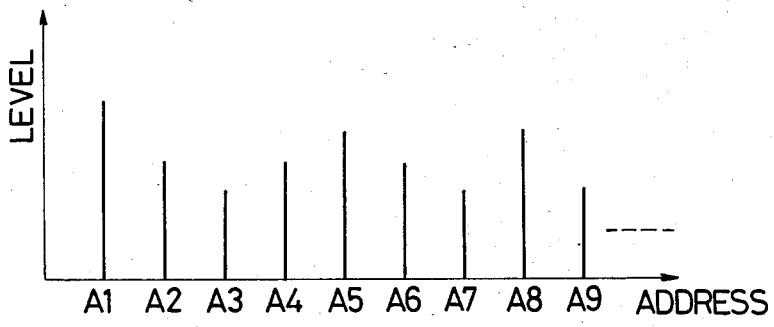
FIG. 5(*a*) is a graph showing the harmonic coefficient data which is stored in the memory of the embodiment shown in FIG. 4.
Figure 5B:
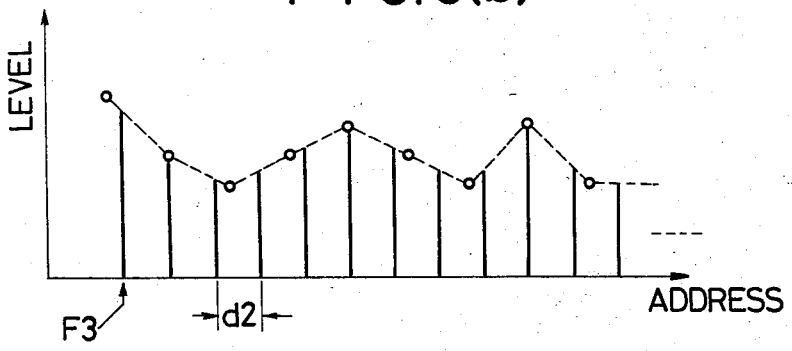
Figure 5C:
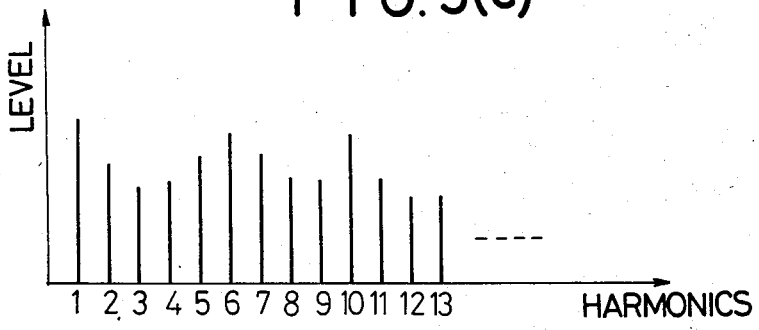

A description will be given, with reference to FIGS. 5(*a*) 5(*c*), of the operation of the embodiment of FIG. 4. In this embodiment, harmonic coefficient data such, for example, as shown in FIG. 5(*a*) is stored, as a representative value. The data itself does not correspond directly to the harmonic coefficient structure of a musical waveform but can be formed arbitrarily in accordance with the musical waveform to be synthesized. When the readout addresses from the address data generator 22 are set by the expression (8) so that F3 in FIG. 5(*b*) is the start of the readout and d2 is the skip value, interpolation values corresponding to harmonic coefficient data P1, P2, . . . in the memory circuit 21 are computed by the interpolation circuit 25. FIG. 5(*c*) shows the interpolation values in the form of harmonic structure of the musical waveform. It is seen from FIG. 5(*c*) that the harmonic coefficient structure is set by the readout addresses from the address data generator 22. The arrangement of this embodiment appears more complex than the arrangement of FIG. 2, but since the storage capacity required of the memory circuit 21 is much smaller than in the case of the latter, this circuit arrangement is rather useful in practice and can be simplified by employing nonlinear interpolation by a shift circuit as the interpolation system of the interpolation circuit 25.

Figure 6:
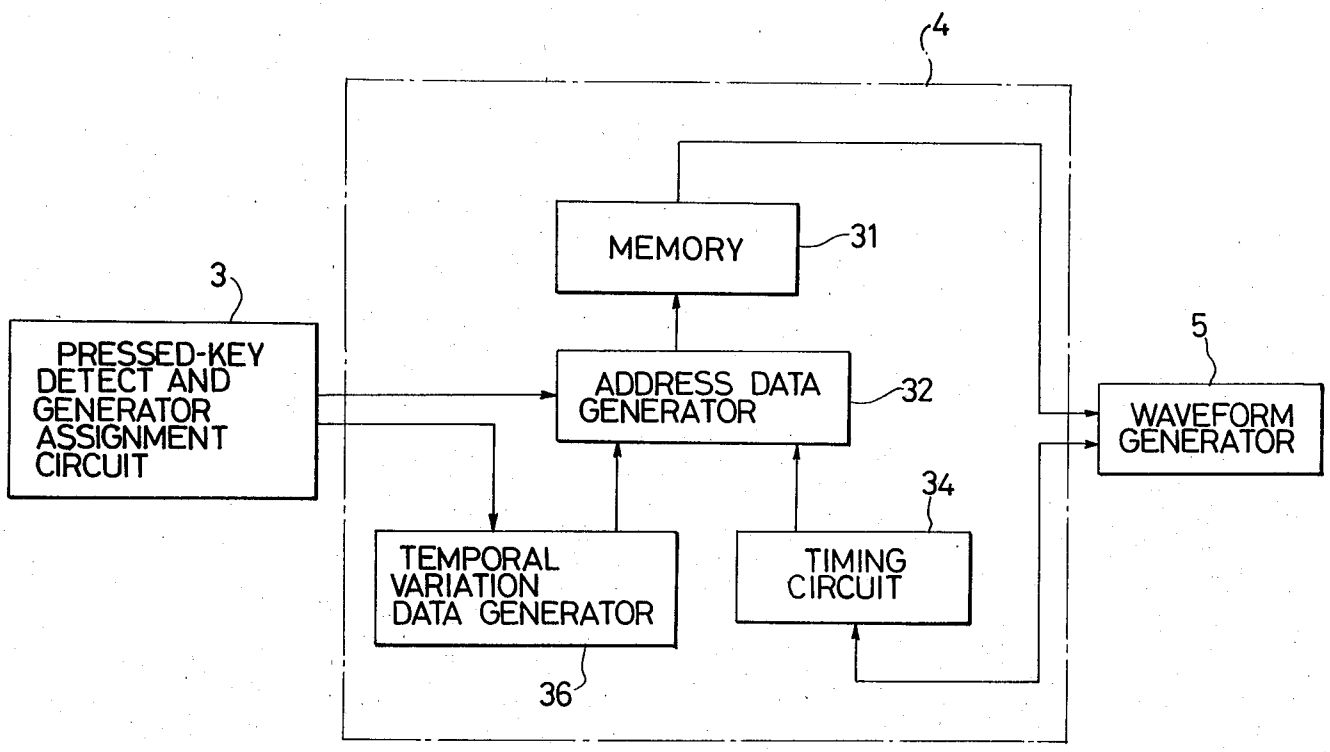
FIG. 6 is a block diagram illustrating still another specific operative example of the arrangement of the harmonic coefficient circuit 4.

FIG. 6 illustrates another embodiment of the harmonic coefficient circuit 4. In FIG. 6, reference numeral 31 indicates a memory circuit which stores a plurality of sets of harmonic coefficient data each set of which is used for Fourier synthesis; 36 designates a temporal variation data generator which generates, in accordance with touch response data from the pressed-key detect and generator assignment circuit, data for varying the component ratio of the harmonic coefficient with time in response to the temporal variations of a musical waveform; 32 identifies an address data generator which generates addresses for reading out the harmonic coefficient data from the memory circuit 31 while varying them in accordance with the temporal variation data; and 34 denotes a timing circuit for synchronizing time-shared operations of the waveform data generator 5 and the address data generator 32.

Figure 7:
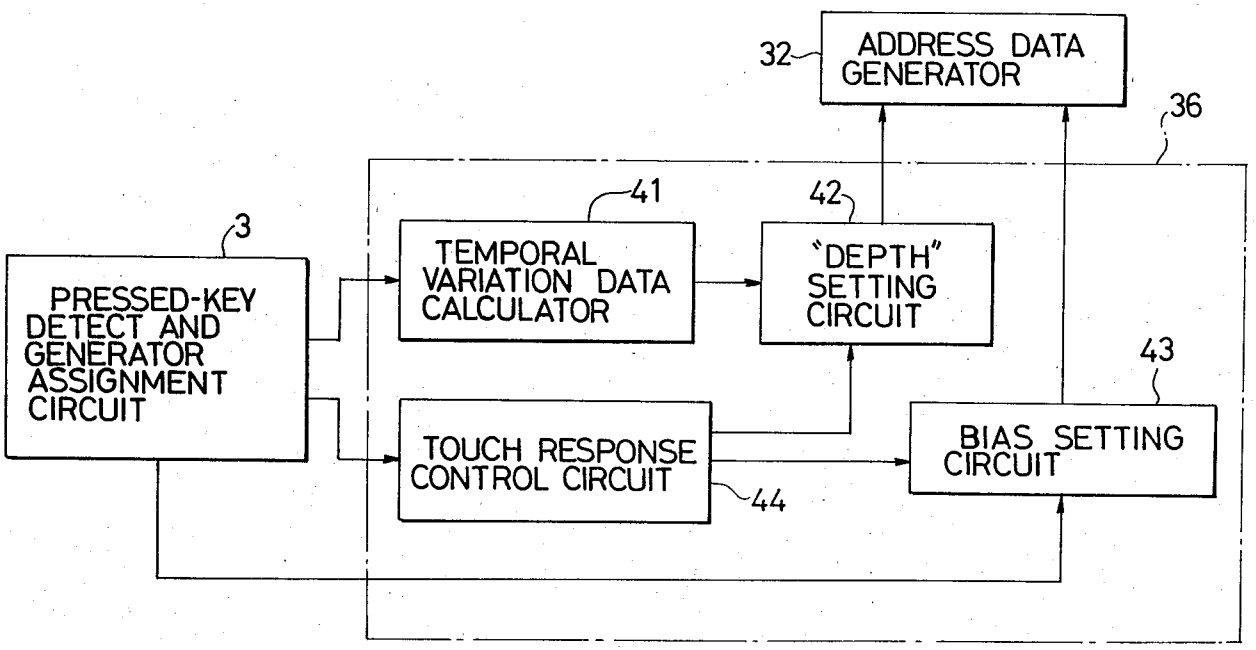
FIG. 7 is a block diagram illustrating a specific operative example of the arrangement of a temporal variation data generator 36 used in FIG. 6.

FIG. 7 illustrates a specific example of the arrangement of the temporal variation data generator 36, explanatory of its operation. In FIG. 7, reference numeral 41 indicaes a temporal variation data calculator which generates data for varying the component ratio of the harmonic coefficient with time in accordance with temporal variations of a musical waveform; 42 designates a "depth" setting circuit for setting the amplitude of the temporal variation data generated by the temporal variation data calculator 41, 43 identifies a bias setting circuit for setting a bias value in accordance with touch response data during performance; and 44 denotes a touch response control circuit for controlling the "depth" setting circuit 42 and the bias setting circuit 43 in accordance with the touch response data from the pressed-key detect and generator assignment circuit 3.

Figures 8A, 8B, 8C, 8D:
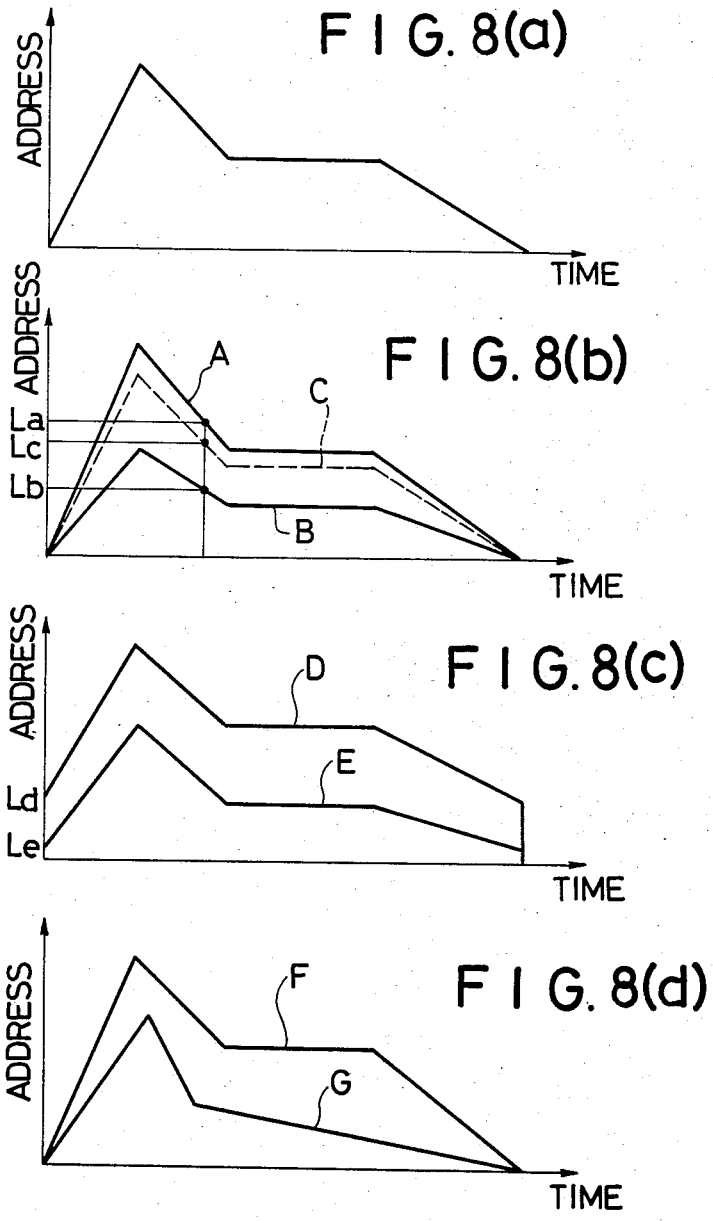
FIG. 8(*a*) is a graph showing an envelope characteristic for a temporal variation of sounds of a natural musical instrument.

A description will be given, with reference to FIGS. 8(*a*) to 8(*d*) of the operation of the embodiment of the present invention shown in FIGS. 6 and 7. The temporal variation data calculator 41 calculates such temporal variation data as shown in FIG. 8(*a*), for instance. Such a temporal variation characteristic curve as shown is a typical one that corresponds to temporal variations in the harmonic characteristic of many natural musical instruments. For the amplitude value of an address signal which is the output signal of the temporal variation data calculator 41, an amplitude value Lc of a curve C at a time t is multiplied by a constant ratio in the "depth" setting circuit 42, thereby obtaining such values as indicated by La and Lb to provide, as a whole, such output signals as indicated by curves A and B in FIG. 8(*b*). By controlling this constant ratio in response to touch response data during performance, the musical waveform generated is provided with disversified temporal variation characteristics. Furthermore, as shown in FIG. 8(*c*), characteristic curves D and E are similar to each other, but when their address bias values differ, as indicated by Ld and Le, the resulting harmonic coefficient characteristics greatly differ. Accordingly, this is effective, for example, for the expression of a high-pitched tone which is produced when a piano is played in fortissimo. Moreover, to use, as the temporal variation data by the temporal variation data calculator 41, not only such a characteristic as indicated by the curve F but also such a characteristic as indicated by the curve G in FIG. 8(*d*) is effective, for instance, for the expression of a sharp attack of a high-pitched tone which is characteristic of the timbre of a harpsichord.

As has been described in the foregoing, according to the electronic musical instrument of the present invention, since harmonic coefficients necessary for Fourier synthesis calculations for realizing temporal variations of a musical waveform can be produced with a simple arrangement in a short time, it is possible to generate a truly musical waveform, overcoming limitations on the degree of harmonic coefficients, the sampling rate and the circuit scale. Furthermore, the present invention achieves simplification of the circuit arrangement and a touch response expression through utilization of an interpolation circuit and a touch response control circuit, and hence offers an electronic musical instrument of high musicality. Accordingly, the present invention greatly contributes to the creation of good music.

It will be apparent that many modifications and variations may be effected without departing from the scope of the novel concepts of the present invention.

What is claimed is:

1. An electronic musical instrument of the type that forms a musical waveform by calculating the waveform amplitude value at each sample point of the musical waveform through Fourier synthesis, comprising:

a memory circuit for storing a plurality of sets of arbitrary harmonic coefficients for use in the Fourier synthesis, each set of arbitrary harmonic coefficients including a series of arbitrary harmonic coefficients occupying different addresses in said memory circuit, said arbitrary harmonic coefficients in each set having a characteristic wave pattern of a musical waveform to be synthesized;

a temporal variation data generating circuit for setting a component ratio of a harmonic coefficient in accordance with temporal variations which vary with time, of a musical waveform to be synthesized, and by selecting from and between the sets of arbitrary harmonic coefficients stored in said memory circuit;

an address data generator for generating readout addresses for reading out one set of the arbitrary harmonic coefficients from the memory circuit in accordance while varying them in response to the temporal variations of the musical waveform to be synthesized;

an interpolation circuit for calculating actual harmonic coefficient data by starting at a starting address of the readout addresses from the address data generator, and by skipping by a selected skip value along the series of arbitrary harmonic coefficients in the readout addresses, the musical waveform to be synthesized having its characteristic wave pattern because of the selection of the set of arbitrary harmonic coefficients while having actual harmonic coefficients calculated by said interpolation circuit.

2. An electronic musical instrument according to claim 1, which includes a bias setting circuit for setting and adding a bias value to each of the readout addresses read out of the memory circuit, and a depth setting circuit for setting the amplitude of the temporal variation data generated by the temporal variation data generator, and wherein the bias value by the bias setting circuit and the amplitude depth value by the depth setting circuit are controlled in accordance with touch response data during a performance.

* * * * *